US010077973B2

(12) United States Patent
Mulcahey

(10) Patent No.: US 10,077,973 B2
(45) Date of Patent: Sep. 18, 2018

(54) BALLISTIC SHIELD FOR A FIREARM

(71) Applicant: Kevin Mulcahey, Fort Mill, SC (US)

(72) Inventor: Kevin Mulcahey, Fort Mill, SC (US)

( * ) Notice: Subject to any disclaimer, the term of this patent is extended or adjusted under 35 U.S.C. 154(b) by 0 days.

(21) Appl. No.: 15/401,687

(22) Filed: Jan. 9, 2017

(65) Prior Publication Data

US 2017/0199012 A1 Jul. 13, 2017

Related U.S. Application Data

(60) Provisional application No. 62/277,036, filed on Jan. 11, 2016.

(51) Int. Cl.
*F41H 5/08* (2006.01)
*F41A 23/08* (2006.01)
*F41H 5/04* (2006.01)

(52) U.S. Cl.
CPC ..... *F41H 5/08* (2013.01); *F41H 5/0485* (2013.01); *F41A 23/08* (2013.01)

(58) Field of Classification Search
CPC ..... F41C 27/00; F41C 27/04; F41H 5/0485; F41H 5/08; F41A 35/02; F41A 23/08
USPC ..... 89/36.05, 36.06; 42/143
See application file for complete search history.

(56) References Cited

U.S. PATENT DOCUMENTS 1,320,888 A * 11/1919 Miller ..... F41H 5/12 42/106
2,364,340 A * 12/1944 Bogg, Jr. ..... F41A 35/02 42/106
2,775,052 A * 12/1956 Musser ..... F41A 23/08 42/94
3,557,384 A * 1/1971 Barron ..... F41H 1/02 2/2.5
4,858,361 A * 8/1989 White ..... F41A 35/02 150/154
5,048,217 A * 9/1991 Easter ..... F41A 35/02 42/96
6,185,738 B1 * 2/2001 Sidebottom ..... F41H 1/02 2/102
8,511,215 B1 * 8/2013 Tervola ..... F41H 5/12 89/36.03
2015/0082524 A1 * 3/2015 Ben David ..... F41H 1/02 2/463
2015/0196099 A1 * 7/2015 Strum ..... A44B 11/006 24/200

(Continued)

*Primary Examiner* — Bret Hayes
(74) *Attorney, Agent, or Firm* — Trego, Hines & Ladenheim, PLLC

(57) ABSTRACT

A ballistic shield apparatus for a weapon includes: a flexible ballistic shield made of penetration-resistant material, the ballistic shield having opposed front and rear faces, spaced-apart side edges connecting spaced-apart top and bottom edges, and a central area bounded by the side edges; one or more flexible securing members extending laterally outward from each of the side edges, each of the one or more flexible securing members including a releasable connector disposed on a distal portion thereof; and at least one releasable connector disposed on the ballistic shield, the releasable connectors collectively configured such that the distal portion of each of the one or more flexible securing members can be releasably secured to the central area of the ballistic shield, or to a distal portion of one of the one or more flexible securing members.

6 Claims, 7 Drawing Sheets

(56) References Cited

U.S. PATENT DOCUMENTS

2015/0285580 A1* 10/2015 Utech ..... F41A 35/02
42/96
2015/0345888 A1* 12/2015 Frazier ..... F41A 35/02
42/96

* cited by examiner

BALLISTIC SHIELD FOR A FIREARM

BACKGROUND OF THE INVENTION

This invention relates generally to firearms and other similar weapons, and more particularly to a defensive shield for a firearm having a bipod.

Weapons such as firearms are frequently used in conditions which subject the weapon user to hazards such as return enemy fire and shrapnel. Various types of personal protective gear exist for weapon users, such as bullet-resistant vests, "flak jackets", "body armor", and the like.

While such conventional protective gear protects the user's torso and vital organs, portions of the user's body such as the hands are still exposed to injury because of their position holding the weapon. The forward hand is particularly vulnerable.

Accordingly, there is a need for a shield providing additional protection for a weapon user.

BRIEF SUMMARY OF THE INVENTION

This need is addressed by the technology described herein, which provides a ballistic shield that protects a user while still permitting operation of a weapon.

According to one aspect of the technology described herein, a ballistic shield apparatus for a weapon includes: a flexible ballistic shield made of penetration-resistant material, the ballistic shield having opposed front and rear faces, spaced-apart side edges connecting spaced-apart top and bottom edges, and a central area bounded by the side edges; one or more flexible securing members extending laterally outward from each of the side edges, each of the one or more flexible securing members including a releasable connector disposed on a distal portion thereof; and at least one releasable connector disposed on the ballistic shield, the releasable connectors collectively configured such that the distal portion of each of the one or more flexible securing members can be releasably secured to the central area of the ballistic shield, or to a distal portion of one of the one or more flexible securing members.

According to another aspect of the technology described herein, a ballistic shield apparatus is provided for a firearm having a stock having a bipod mounted thereto, the stock carrying a receiver with a sighting device mounted thereto, and having a barrel extending therefrom. The ballistic shield apparatus includes: a flexible ballistic shield made of penetration-resistant material, the ballistic shield having opposed front and rear faces, spaced-apart side edges connecting spaced-apart top and bottom edges, and a central area bounded by the side edges; and a plurality of flexible securing members extending laterally outward from the side edges, the securing members selectively configurable in: a first configuration in which distal portions of the securing members are wrapped around the bipod and releasably connected to the central area of the ballistic shield; and a second configuration in which the flexible ballistic shield is wrapped around the receiver and the sighting device, and distal portions of opposing flexible securing members are releasably connected to each other.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
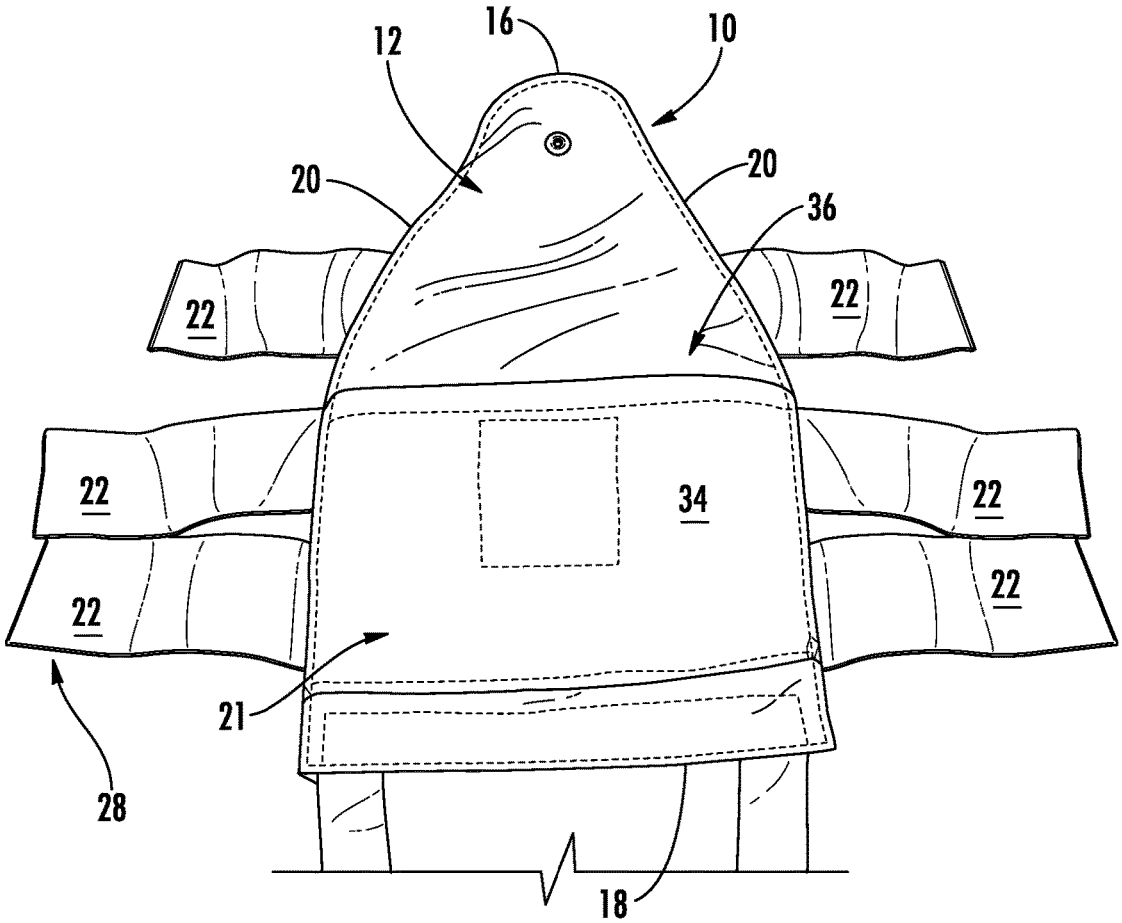
FIG. 1 is a front elevation view of a ballistic shield.
Figure 2:
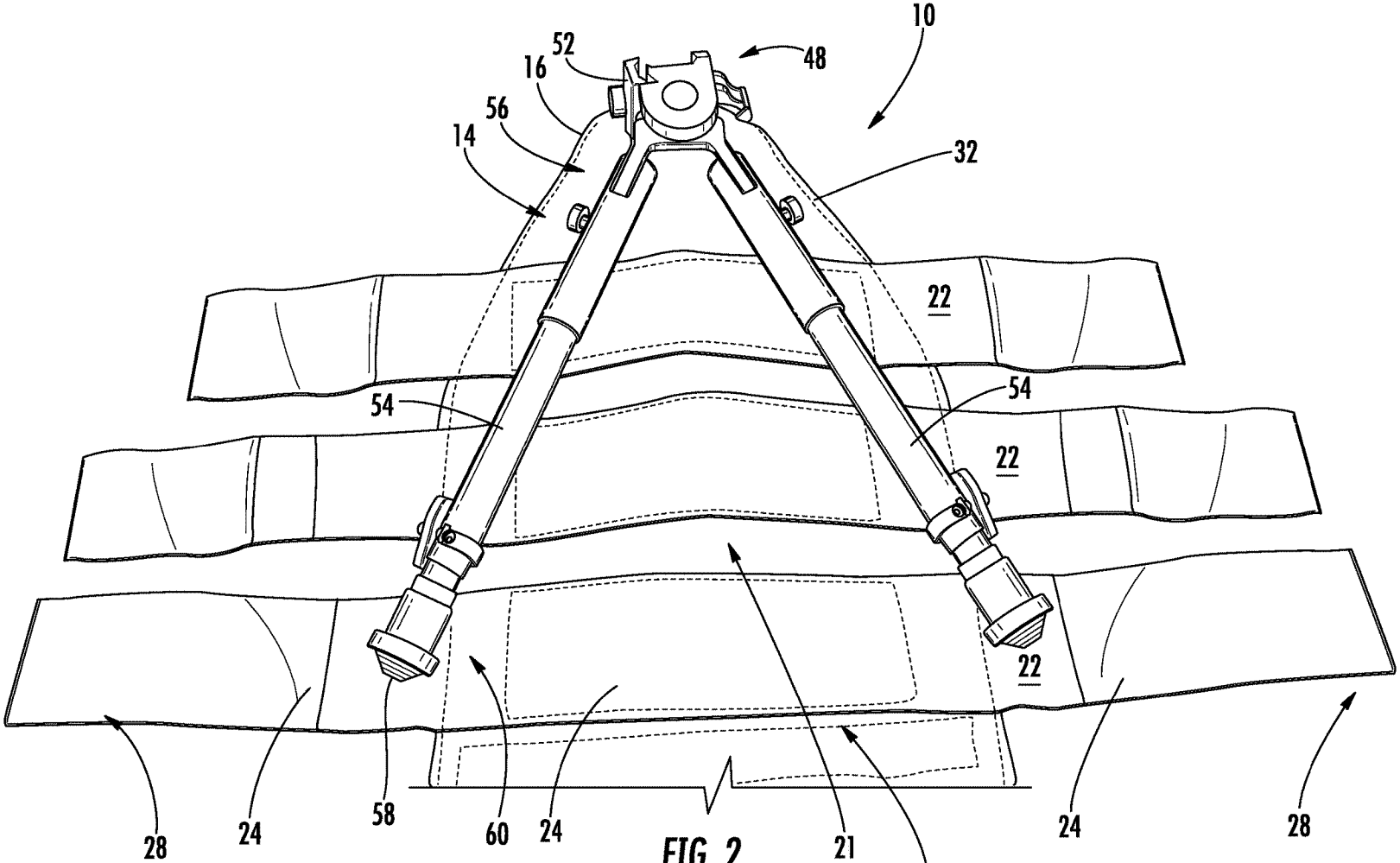
FIG. 2 is a rear elevation view of the ballistic shield of FIG. 1.

Referring to the drawings wherein identical reference numerals denote the same elements throughout the various views, FIGS. 1 and 2 illustrate an exemplary ballistic shield 10. The ballistic shield 10 has opposed front and rear faces 12 and 14, a top edge 16, and a bottom edge 18. Side edges 20 interconnect the top and bottom edges 16 and 18. In the illustrated example, each side edge 20 includes a lower section that is perpendicular to the bottom edge 18, and an upper section that extends from the lower section to the top edge 16, making the upper portion of the ballistic shield 10 generally trapezoidal, and the lower portion generally rectangular. The ballistic shield 10 includes a central area 21 positioned between and bounded by the side edges 20.

The ballistic shield 10 incorporates means for attachment to a bipod or similar support. In the illustrated example the ballistic shield 10 has straps 22 which extend laterally outward from the side edges 20. For the purposes of this invention, the straps constitute an example of a "flexible securing member". The straps 22 incorporate suitable releasable connectors 24. As used herein the term "releasable" refers to a connection that can be coupled and uncoupled in ordinary use without damage to the connectors or resorting to the use of tools. By way of example and not of limitation, examples of releasable connectors include buttons, snaps, stud-type snap fasteners, magnets, and hook-and-loop type fasteners (e.g. VELCRO). The illustrated example shows hook-and-loop fasteners. As an example, each of the straps 22 can be formed from a single piece of material, such as fabric webbing, having a central portion 26 attached to the rear face 14 (overlying the central area 21) and distal portions 28 extending beyond the side edges 20. As will be explained further below, the connectors 24 may be configured so that each distal portion 28 can be releasably attached to either the central area 21 (e.g. via releasable connector 24 of the central portion 26) or to the opposing distal portion 28. In FIGS. 1 and 2 three straps 22 are shown. The number, size, and location of the straps 22 can be modified to suit a specific application.

The ballistic shield 10 is constructed so as to be penetration-resistant, or in other words resistant to penetration by moving projectiles, such as bullets and shrapnel. Non-limiting examples of suitable materials include metal alloys, ceramics, composite materials, and ballistic fabrics. In the illustrated example the ballistic shield 10 incorporates layers of fabric made from aramid fibers available under the trade name KEVLAR. The layers of fabric may be sandwiched between front and rear cover layers of fabric that form the front and rear faces 12 and 14, respectively. The cover layers may be secured together with stitching 32.

The construction of the ballistic shield 10 may be flexible in whole or part. As used herein, the term "flexible" refers to a structure configured such that it will flex or bend forwards and backwards under its own weight. Nonlimiting examples of flexible structures include structures made in whole or part from fabric.

Optionally, the ballistic shield 10 may incorporate an internal pocket 34 that communicates with an opening 36 formed in the front face 12. The opening 36 could also be formed in the rear face 14. The pocket 34 is sized and shaped to hold a reinforcing plate therein (not shown). The reinforcing plate is configured to increase the resistance of the ballistic shield 10 to penetration, and may be made from a material such as steel, ceramic, or other material. As shown, the opening 36 may be placed at the upper end of the pocket 34 so that the reinforcing plate is naturally held in position by gravity during use.

Figure 3:
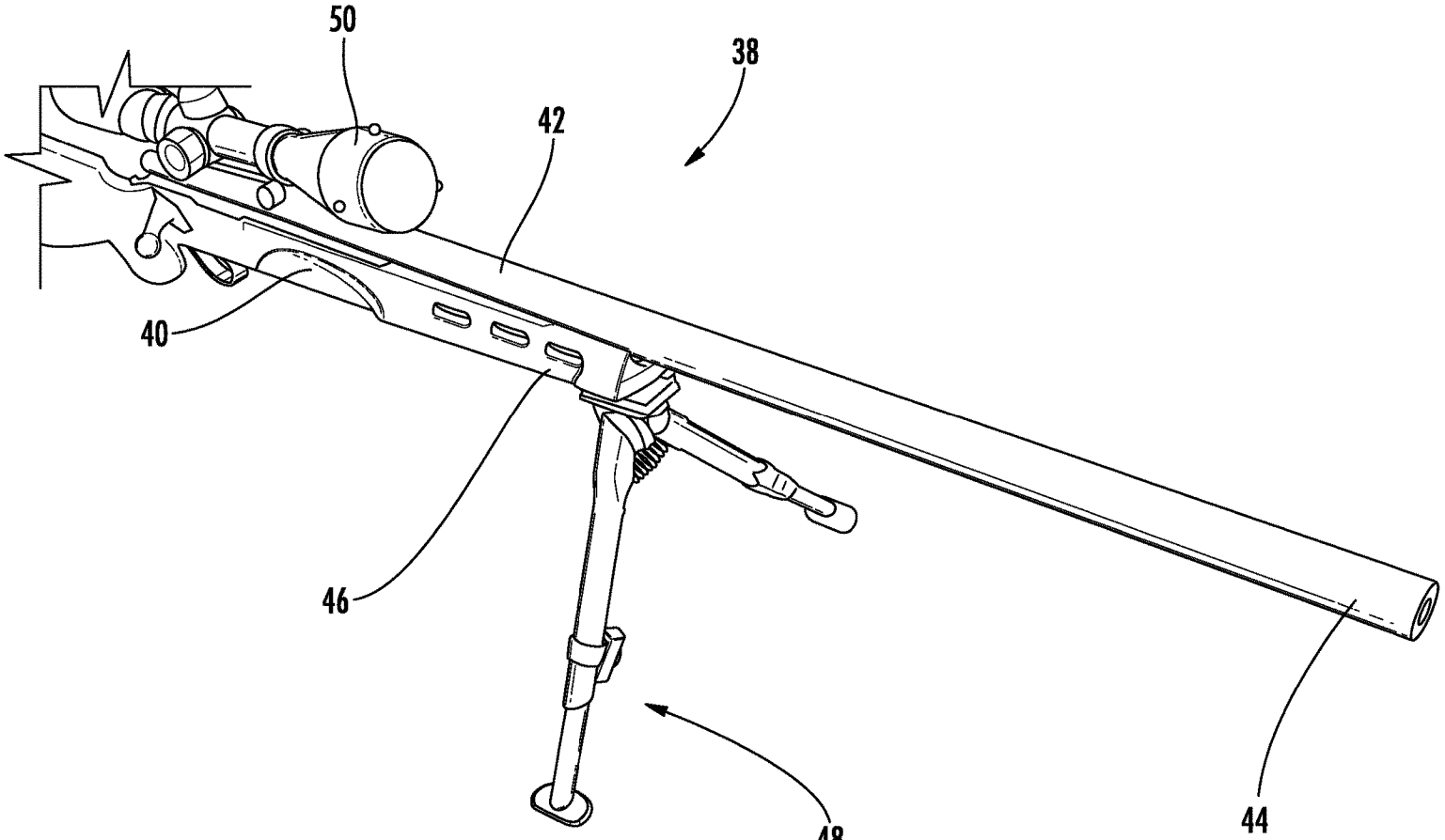
FIG. 3 is a front perspective view of a rifle having a bipod mounted thereto.
Figure 4:
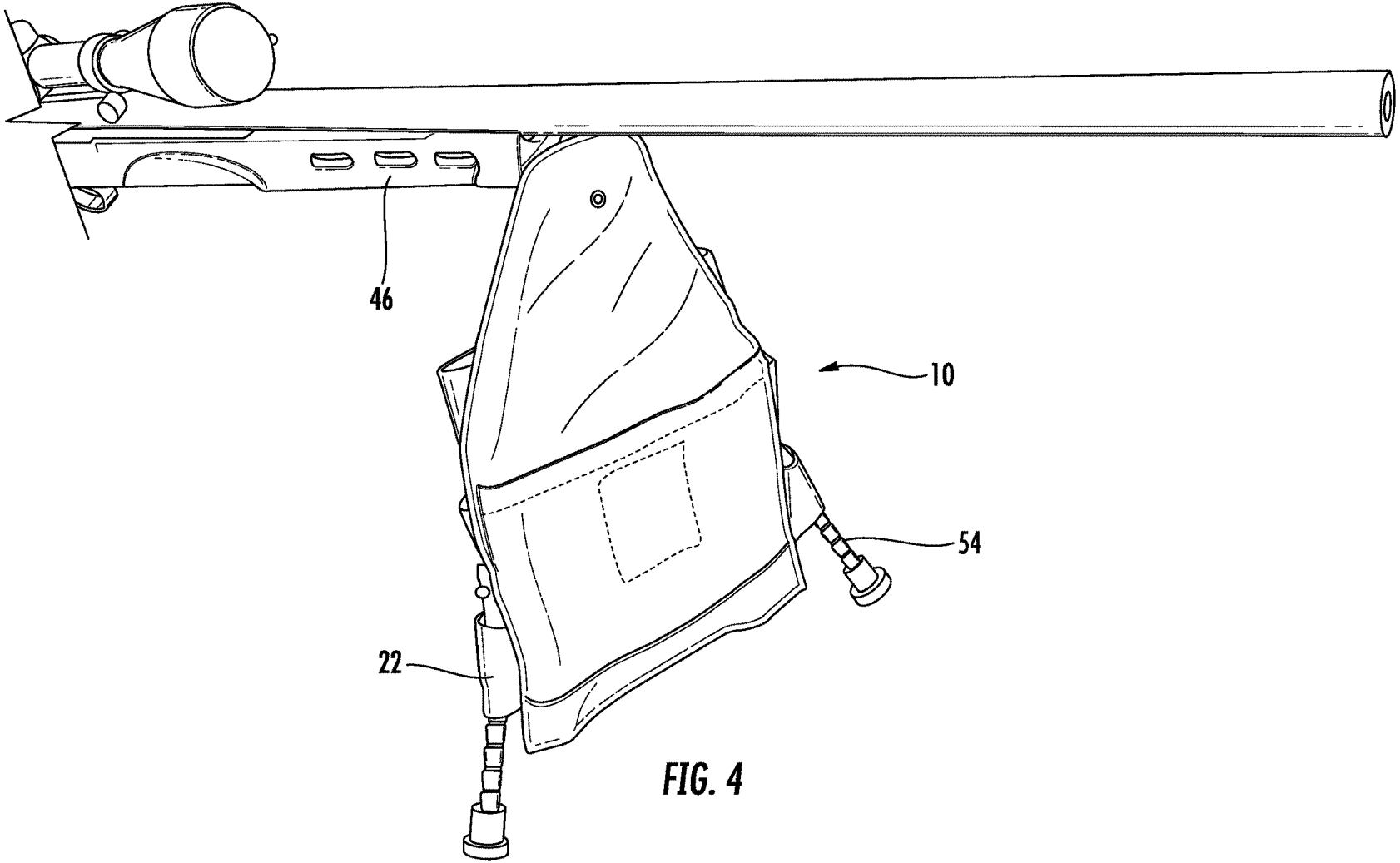
FIG. 4 is a front perspective view of rifle of FIG. 3 with the ballistic shield of FIG. 1 mounted thereto.
Figure 5:
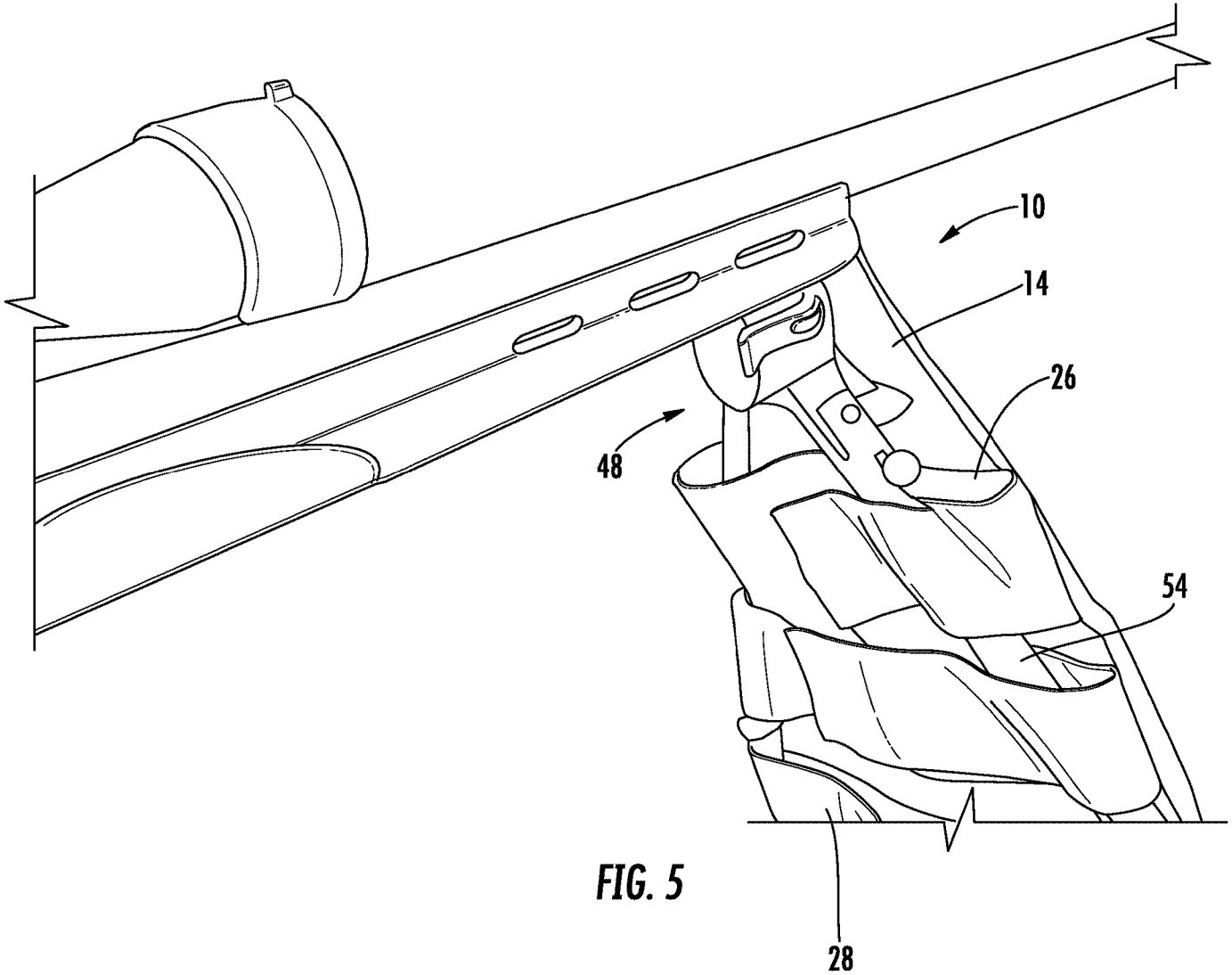
FIG. 5 is a rear perspective view of the rifle and ballistic shield of FIG. 4.

FIGS. 3-5 show how the ballistic shield 10 may be mounted to a firearm or other weapon. For reference purposes, FIG. 4 illustrates a conventional firearm 38 having a stock 40 carrying a receiver 42 and a barrel 44. The stock 40 includes a forearm 46 and a bipod 48 is mounted thereto. A conventional scope 50 or other type of sighting device is mounted to the receiver 42.

The bipod 48 is of conventional construction. As seen in FIGS. 2 and 3, it includes a mount 52 configured to be attached to the firearm 38, and a pair of legs 54. Proximal ends 56 of the legs 54 are attached to the mount 52, and feet 58 are provided at distal ends 60 of the legs 54. In use the legs 54 are disposed in a splayed-out arrangement to provide a steady base to stabilize the firearm 38, as shown in FIG. 3. In accordance with conventional practice, the legs 54 may be folding and/or telescoping to enable the bipod 48 to be folded in a compact shape when not in use and adjusted for use on various surfaces.

FIGS. 4 and 5 show the ballistic shield 10 mounted to the bipod 48. It can be seen that the rear face 14 lies against the deployed legs 54. The straps 22 are wrapped around the legs 54 and the distal portions 28 are connected to the central area 21 (via the central portions 26), securing the ballistic shield 10 in place. In this position, the ballistic shield 10 provides protection for the user of the firearm 38.

Figure 6:
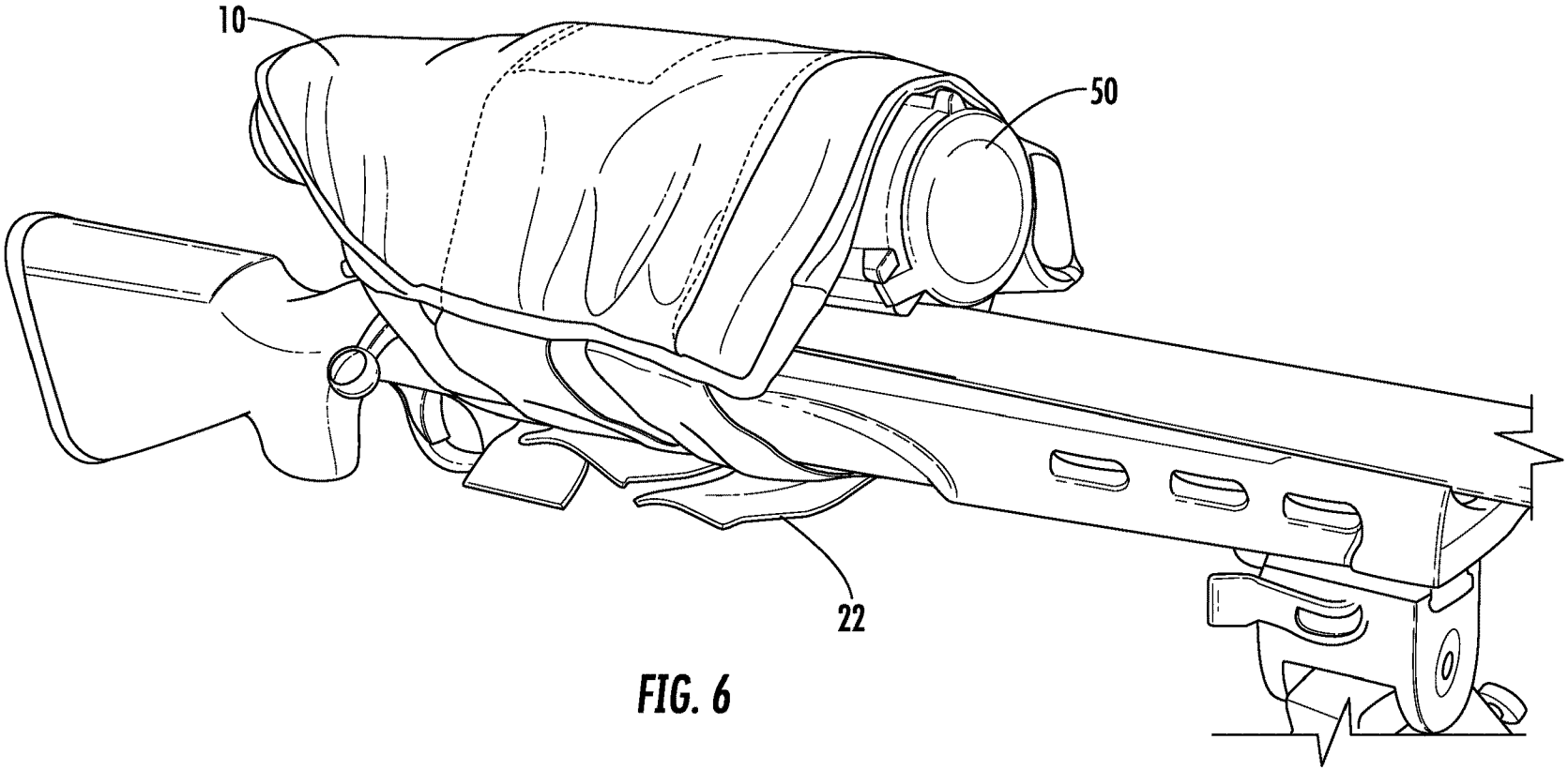
FIG. 6 is a front perspective view of the rifle of FIG. 3 with the ballistic shield of FIG. 1 covering a scope of the rifle.

The ballistic shield 10 can also be used for other functions. For example, FIG. 6 shows the ballistic shield 10 wrapped around the scope 50 and secured in position using the straps 22. This provides protection for the scope 50 from physical damage, water, etc.

Figure 7:
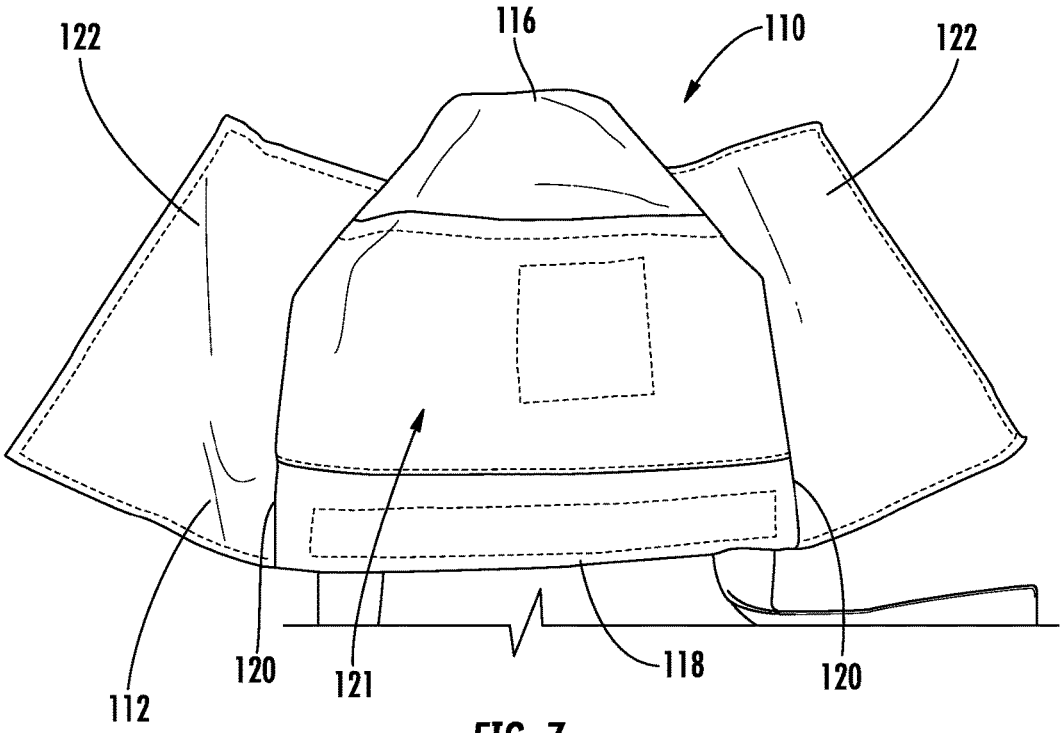
FIG. 7 is a front elevation view of an alternative ballistic shield.
Figure 8:
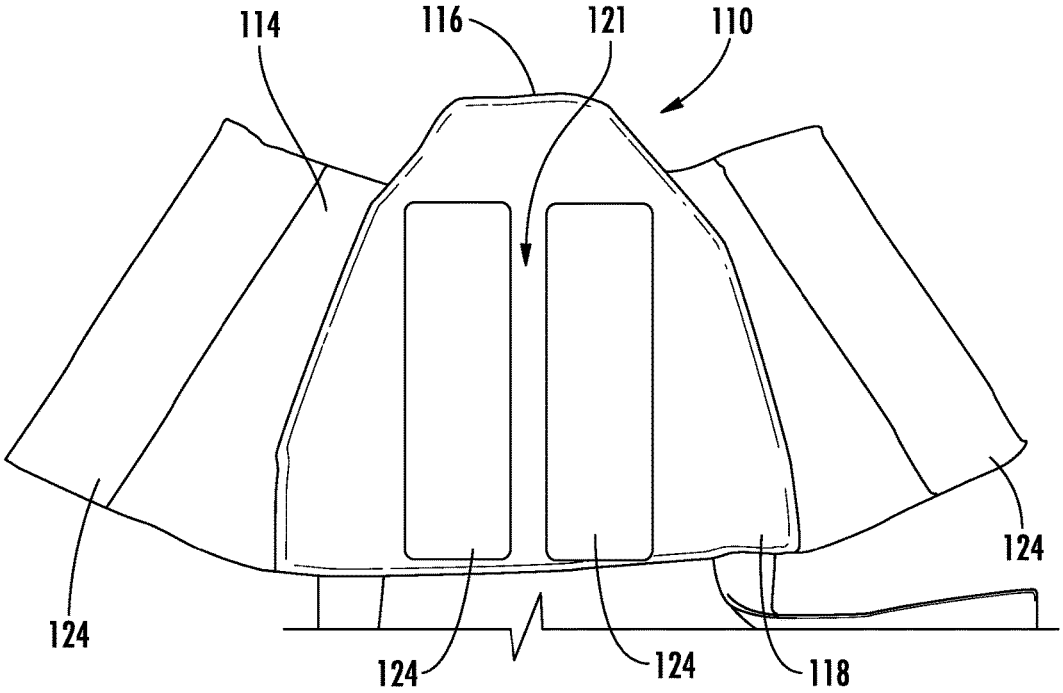
FIG. 8 is a rear elevation view of the ballistic shield of FIG. 7.

FIGS. 7 and 8 illustrate an alternative ballistic shield 110 similar in construction to the ballistic shield 10 described above. The ballistic shield 110 has opposed front and rear faces 112 and 114, top and bottom edges 116 and 118, and side edges 120 bounding a central area 121. In lieu of the straps 22 described above, the ballistic shield 110 includes side flaps 122 extending laterally outward from the side edges 120. For the purposes of this invention, the side flaps 122 constitute an example of a "flexible securing member". The side flaps 122 and the central area 121 incorporate suitable releasable connectors 124. The illustrated example shows hook-and-loop fasteners. The attachment and use of the ballistic shield 110 to a firearm 38 is substantially the same as for the ballistic shield 10 described above.

The foregoing has described a ballistic shield for a weapon. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying potential points of novelty, abstract and drawings), or to any novel one, or any novel combination, of the steps of any method or process so disclosed.

What is claimed is:

1. In combination, a firearm having a stock having a bipod mounted thereto, the stock carrying a receiver with a sighting device mounted thereto, and having a barrel extending therefrom, and:

a ballistic shield apparatus comprising:

a flexible ballistic shield made of penetration-resistant material, the ballistic shield having opposed front and rear faces, spaced-apart side edges connecting spaced-apart top and bottom edges, and a central area bounded by the side edges;

a pocket communicating with an opening formed in one of the front and rear faces; and a reinforcing plate disposed in the pocket; and a plurality of flexible securing members extending laterally outward from the side edges, wherein the ballistic shield apparatus is combined with the firearm in either:

a first configuration in which distal portions of the securing members are wrapped around the bipod and releasably connected to the central area of the ballistic shield; or a second configuration in which the flexible ballistic shield is wrapped around the receiver and the sighting device, and distal portions of opposing flexible securing members are releasably connected to each other.

2. The apparatus of claim 1 wherein the ballistic shield is made from fabric comprising aramid fibers.

3. The apparatus of claim 1 wherein each of the flexible securing members comprises a strap.

4. The apparatus of claim 1 in which the central area of the ballistic shield and the distal portions of the flexible securing members include releasable connectors.

5. The ballistic shield apparatus of claim 4 wherein the releasable connectors comprise hook-and-loop fasteners.

6. In combination, a firearm having a stock having a bipod mounted thereto, the stock carrying a receiver with a sighting device mounted thereto, and having a barrel extending therefrom, and:

a ballistic shield apparatus comprising:

a flexible ballistic shield made of penetration-resistant material, the ballistic shield having opposed front and rear faces, spaced-apart side edges connecting spaced-apart top and bottom edges, and a central area bounded by the side edges;

a plurality of flexible securing members extending laterally outward from the side edges, wherein each of the flexible securing members comprises a strap, each strap including a central portion extending across the central area of the ballistic shield; and a releasable connector is disposed on the central portion of the strap, wherein the ballistic shield apparatus is combined with the firearm in either:

a first configuration in which distal portions of the securing members are wrapped around the bipod and releasably connected to the central area of the ballistic shield; or a second configuration in which the flexible ballistic shield is wrapped around the receiver and the sighting device, and distal portions of opposing flexible securing members are releasably connected to each other.

* * * * *